United States Patent [19]

Butler et al.

[11] Patent Number: 4,917,789

[45] Date of Patent: Apr. 17, 1990

[54] CATALYTIC DEWAXING PROCESS

[75] Inventors: James R. Butler; William P. Licht, both of Big Spring, Tex.

[73] Assignee: Fina Technology, Inc., Dallas, Tex.

[21] Appl. No.: 10,224

[22] Filed: Feb. 3, 1987

[51] Int. Cl.[4] ..... C10G 47/16; C10G 11/05

[52] U.S. Cl. ..... 208/89; 208/109; 208/111; 208/118; 208/120

[58] Field of Search ..... 208/111, 109, 89, 18, 208/15, 57, 118, 120

[56] References Cited

U.S. PATENT DOCUMENTS

| | | | |
|---|---|---|---|
| 4,309,276 | 1/1982 | Miller | 208/109 |
| 4,361,477 | 11/1982 | Miller | 208/18 |
| 4,370,219 | 1/1983 | Miller | 208/59 |
| 4,416,766 | 11/1983 | Mulaskey | 208/109 |
| 4,548,705 | 10/1985 | Young et al. | 208/109 |
| 4,560,469 | 12/1985 | Hopkins et al. | 208/59 |
| 4,648,958 | 3/1987 | Ward | 208/109 |

*Primary Examiner*—Anthony McFarlane

*Attorney, Agent, or Firm*—William D. Jackson; John K. Abokhair; M. Norwood Cheairs

[57] ABSTRACT

A process for reducing the pour point of sulfur containing gas oil fractions to produce fractions, including diesel oil of reduced pour point involving sequential hydrotreating and dewaxing of the gas oil feedstock. The hydrotreating step is carried out over a conventional hydrodesulfurization catalyst to remove sulfur. The dewaxing step is carried out over silicalite at mild dewaxing conditions under which the $C_3$ and lower gas make is no greater than 2 wt. % based upon the gas oil feed.

17 Claims, No Drawings

CATALYTIC DEWAXING PROCESS

FIELD OF THE INVENTION

The present invention relates to a process for the hydrotreating and catalytic dewaxing of hydrocarbon feed materials. In a specific aspect, the present invention relates to a process for upgrading hydrocarbon feeds wherein the process is characterized by having significantly reduced gas make.

BACKGROUND OF THE INVENTION

Increasing the total yield of distillates and gasoline obtained from crude petroleum has long been an important refining problem, especially in areas where only limited cracking capacity is available. Increasing the yield of distillates by increasing the distillate end point is often restricted by unacceptable high pour/cloud points of the resulting fuels.

In typical refinery operations, products include, from lighter to heavier products, LP gas, solvents, motor gasoline, jet fuel, kerosene, diesel fuel, distillate burner fuels, residual fuel oil, lube oil, and waxes (microcrystalline and paraffin). Of particular interest are those liquid hydrocarbons boiling in the 400°-850° F. range. These include jet fuel, kerosene, diesel fuel, distillate burner fuel, and residual fuel oil. The end points of these hydrocarbon fractions are limited to meet specification pour points and cloud points. For example, normally in a topping-reforming operation, the about 650° F.+ residium is rejected as diesel to distillate burner fuels and the like. Often there is a high economic incentive for refiners to increase jet fuel, kerosene and diesel fuel yield and decrease lower burner fuels output per barrel of crude. To achieve this objective, it is highly desirable to convert as much of the 650° F. fraction of the residium into lower pour/cloud point diesel fuel.

One method of reducing the pour/cloud points is to blend lighter cuts material, such as kerosene, with the diesel fuel. However, such a method is not cost effective since the lighter material can be sold for higher prices. For example, kerosene can be sold as jet fuel.

Another method to achieve the above is to utilize catalytic dewaxing. Catalytic dewaxing of petroleum and synthetic crude oil fractions in the presence of shape selective catalysts capable of selectively cracking n-paraffins and isoparaffins is well known. For example, U.S. Re. Pat. No. 28,398 (Chen et al), which is a reissue of U.S. Pat. No. 3,700,585, discloses the use of shape selective crystalline aluminosilicate zeolite ZSM-5 in catalytic dewaxing processes directed at removing high freezing point paraffins from jet fuel to lower the freezing point, improve the octane rating of naphtha fractions and lower the pour point of lube oil base stocks. According to Chen et al, the shape selective cracking ability of crystalline aluminosilicate ZSM-5 permits selective cracking of n-paraffins and certain isoparaffins without substantial cracking of desirable feed components such that improved catalytic dewaxing products are obtained under both hydrotreating and hydrocracking conditions. Chen et al also discloses the use of crystalline aluminosilicate zeolite ZSM-5 associated with hydrogenating metals such as tungsten, vanadium, molybdenum, rhenium, nickel, cobalt, chromium, manganese, platinum or palladium, such metals being associated with the zeolite by exchange or impregnation.

European Patent Application No. 0079778 discloses a process for catalytic dewaxing-hydrotreating of hydrocarbon feed materials comprising contacting the feed with hydrogen under catalytic dewaxing-hydrotreating conditions in the presence of a catalyst comprising a shape selective zeolitic cracking component and a hydrogenating component of improved thermal stability comprising a chromium component, at least one other Group VIB metal component and at least one Group VIII metal component. According to a specific aspect of the invention, the catalytic dewaxing-hydrotreating process is employed to convert hydrocarbon feeds of either high or low quality to lube oil base stocks of high viscosity index, low pour point and good stability in a single step.

U.S. Re. Pat. No. 30,529 (Reynolds), which is a reissue of U.S. Pat. No. 4,100,056, discloses catalytic dewaxing of atmospheric and vacuum distillates in the presence of a catalyst containing mordenite in hydrogen form and a Group VI or Group VIII metal to obtain naphthenic lube oils of intermediate viscosity index and pour points ranging from −46° to −7° C. (−50° to 20° F.).

U.S. Pat. No. 4,222,855 to Pelrine et al discloses catalytic dewaxing of 232°-566° C. (450°-1,050° F.) hydrocarbon fractions to produce high viscosity index lube oils employing a catalyst containing crystalline aluminosilicate zeolite ZSM-23 or ZSM-35, preferably in hydrogen form and associated with platinum, palladium, or zinc. According to Pelrine et al, the use of catalysts containing crystalline aluminosilicate zeolite ZSM-23 or ZSM-35 gives products of higher viscosity index and lower pour point than products obtained through the use of crystalline aluminosilicate zeolite ZSM-5.

U.S. Pat. No. 4,247,388 (Banta et al) is directed to improving crystalline aluminosilicate zeolites such as ZSM-5 in terms of dewaxing performance by treatment to adjust alpha activity. The alpha activity is adjusted by partial replacement of cationic sites of the crystalline aluminosilicate zeolite with basic cations such as sodium, by partial coking of the zeolite, by employing the zeolite in combination with an inert matrix material, by manipulating the silica to alumina ratio of the zeolite to provide a relatively high ratio, or preferably, by steaming. Crystalline aluminosilicate zeolites adjusted in terms of alpha activity can be employed in association with exchanged or impregnated hydrogenating metals such as tungsten, vanadium, molybdenum, rhenium, nickel, cobalt, chromium, manganese, platinum or palladium.

U.S. Pats. Nos. 4,251,348 and 4,282,085 (both O'Rear) are directed to processes similar to those described hereinabove wherein a low nitrogen content petroleum distillate fraction boiling from 82°-649° C. (180°-1,200° F.) is contacted with crystalline aluminosilicate zeolite in a form substantially lacking in hydrogenation activity to form an effluent which then is fractionated into an upgraded product stream and a $C_3$-$C_4$ olefin fraction. If desired, the crystalline aluminosilicate zeolite can be dispersed in a porous matrix having only insubstantial cracking activity. Suitable matrix materials include pumice, firebrick, diatomaceous earth, alumina, silica, zirconia, titania, amorphous silica-alumina mixtures, bentonite, kaolin, silica-magnesia, silica-zirconia or silica-titania.

U.S. Pat. No. 4,259,174 (Chen et al) discloses catalytic dewaxing of hydrocarbon feeds to reduce pour point and produce high viscosity index distillate lube oil stocks in the presence of a synthetic offretite crystalline aluminosilicate zeolite catalyst which may contain exchanged or impregnated hydrogenating metals such as tungsten, vanadium, molybdenum, rhenium, nickel, cobalt, chromium, manganese, platinum or palladium. The crystalline aluminosilicate zeolite may be dispersed within a matrix of alumina, silica, silica-alumina, etc.

An abstract of British patent No. 2,005,120 (Mobil) discloses a method for reclaiming or upgrading contaminated, dewaxed lube oil base stocks having a tendency to form a waxy haze during storage, comprising contacting the oil with hydrogen at 260°-357° C. (550°-674° F.) and space velocity of 2-10 in the presence of a crystalline aluminosilicate zeolite having a silica to alumina ratio of at least 12 and a constraint index of 1-12.

The majority of the above line of references utilize one form or the other of crystalline aluminosilicate zeolite catalyst. Crystalline aluminosilicates are expensive and not readily available. Furthermore, aluminosilicates are known to be sensitive to steam and contaminants such as nitrogen and sulfur.

In most petroleum processing operations, it is conventional to pretreat the charge stock in some manner calculated to remove sulfur, metals and/or nitrogen from the charge stock prior to converting and upgrading such charge stock. Thus, catalytic hydrodesulfurization is commonly used in refineries. It normally precedes reforming and other conversion processes because sulfur, metals and nitrogen present in the charge stock often have detrimental effects on hydrocarbon conversion catalysts. Such contaminants tend to concentrate in the heavier petroleum fractions and thus would be present in the middle range fractions of kerosene and diesel fuel. Thus, it is common to subject these fractions to hydrodesulfurization and dewaxing.

Several patents discuss the relationship between hydrodesulfurization (often referred to as heavy distillate hydrotreating) and dewaxing. For example, U.S. Pat. No. 3,894,938 to Gorring et al discloses a process for catalytic dewaxing and desulfurization of high pour point, high sulfur gas oils to lower their pour point to about 10° F. or lower and their sulfur content by contacting a high pour point gas oil first with a ZSM-5 type zeolite hydrodewaxing catalyst which may contain a hydrogenation/dehydrogenation component, in the presence or absence of added hydrogen under low pressure conditions, followed by conventional hydrodesulfurization processing of the dewaxed intermediate. Gorring states that the sequence of first dewaxing with a ZSM-5 catalyst and subsequent hydrodesulfurization (HDS) results in liquid yield levels of about 84% and dewaxing catalyst life of about 20-400 days between regenerations. Gorring further states that reversing the sequence of operations, i.e., HDS followed by dewaxing, drastically reduced the ZSM-5 catalyst life to about 1-24 hours between regenerations.

U.S. Pat. No. 4,394,249 to Shen discloses a process wherein a hydrocarbon feedstock is desulfurized in a conventional hydrodesulfurization process unit (HDS) and then conducted into a catalytic dewaxing process unit (CDW). The cascading relationship of the HDS/CDW units enables the operator of the plant to recover a substantial portion of thermal energy from a number of process streams and decreases the size of the compressor required in the plant. The patent teaches a very specific sequence and mechanical systems to recover thermal energy from the various process streams and transfer such from one unit operation to another. The CDW catalyst proposed is an aluminosilicate. No mention is made of catalyst life or liquid yield.

U.S. Pat. No. 4,400,265 to Shen discloses a process wherein a high pour point, high sulfur content gas oil is processed in a combination process wherein the gas oil is first catalytically dewaxed and then hydrodesulfurized in a cascade system which enables the two operations to be integrated through a common hydrogen system and whereby substantial quantities of thermal energy are recovered for reuse resulting in significant energy conservation. Again, this patent is directed to the mechanics of the operation and not the chemistry such as CDW catalyst life and liquid yields.

U.S. Pat. No. 4,428,825 (Ward et al) discloses a process for the production of lubricating oils which involves hydrodewaxing over a composite catalyst having a Group VIB or Group VIII metal component on an aluminosilicate or silicalite support in the presence of added ammonia or ammonia precursors. The patentees suggest that suitable feedstocks contain organosulfur and/or organonitrogen compounds to provide total sulfur and total nitrogen contents within the range of 50-1000 ppm and 50-400 ppm, respectively. Preferably, the catalyst is sulfided and such sulfiding may be accomplished by placing the catalyst in service in the oxide form such that it is contacted with organosulfur compounds in the feedstock. The Ward procedure is said to consume less hydrogen and provide a product of increased viscosity index.

U.S. Pat. No. 4,309,275 to Mulaskey discloses a catalytic dewaxing process in which a paraffinic hydrocarbon containing feedstock, ranging from napthta up through lube oil stocks but preferably boiling in excess of 200° C., is contacted with a silicalite catalyst to produce an effleunt of greater olefin content than the feed. Mulaskey discloses that if sulfur compounds are present in the feed it can be lightly hydrotreated to less than 100, and preferably less than 50, ppm in order to lessen the possibility of mercaptan producing reactions. Feedstocks disclosed in Mulaskey include vacuum gas oils and neutral lube oil stocks containing about 2 wt. % and 6 ppm sulfur, respectively, and having initial boiling points in excess of 300° C.

U.S. Pat. No. 4,439,329 to Eberly et al discloses a hydroprocessing process involving simultaneous hydrodesulfurization and pour point reduction of sulfur contaminated feed streams over a catalyst comprising silicalite composited with a nonzeolitic inorganic oxide support having a hydrogenation component associated therewith. Feedstocks containing from about 0.3-5 wt. % sulfur are disclosed as being treated over silicalite catalyst modified by the inclusion of about 6-12% cobalt and molybdenum oxides.

SUMMARY OF THE INVENTION

The present invention relates to a process for catalytically dewaxing hydrocarbon feeds comprising passing the hydrocarbon feed through a reaction zone containing a crystalline silica polymorph silicalite catalyst under mild dewaxing conditions wherein the $C_3$ and lower hydrocarbon gas make is not greater than 2 wt. %, and preferably not more than 1 wt. %, based on the feed. In a further aspect of the invention, the mild dewaxing conditions are such to provide limited hydrocracking so that the liquid yield from the process is greater than the volume of the feed; that is, the volume of the liquid yield is more than 100% of the volume of the feed.

A preferred embodiment of the invention involves a dewaxing process providing a diesel oil fraction of reduced pour point. In this embodiment, a hydrocarbon fraction having an initial boiling point of less than 500° F. and a final boiling point of less than 900° F. is supplied to a first reaction zone containing a hydrotreating catalyst. The hydrotreating catalyst is operated at a temperature within the range of 550°-800° F. and a pressure of at least 300 psia to hydrotreat the fraction to remove sulfur therefrom. The hydrotreated fraction is supplied from said first reaction zone to a second reaction zone where the hydrocarbon feed is subjected to dewaxing over a silicalite dewaxing catalyst to provide a product having a pour point which is at least 5° F., and preferably at least 10° F. lower than the pour point of the feed. The second reaction zone is operated under conditions including a temperature within the range of 650°-850° F. to limit the amount of $C_1$-$C_3$ hydrocarbons produced by the cracking of the fraction to no more than 2% by weight of the feed supplied to the first reaction zone.

Preferably, the hydrotreating and dewaxing procedures are carried out under separate reactors and the hydrotreating reaction, which is exothermic, is carried out at a lower temperature than the dewaxing treatment. More particularly, the inlet temperature to the second reaction zone is at least 50° F. greater than the inlet temperature to the first reaction zone.

DESCRIPTION OF THE PREFERRED EMBODIMENTS

The process of the present invention comprises subjecting the hydrocarbon feed to catalytic hydrodesulfurization (HDS) and catalytic dewaxing (CDW) utilizing a silicalite catalyst under conditions sufficient to reduce the pour point and cloud point without resulting in $C_3$ and lower hydrocarbon gas make in excess of 2 wt. % while at the same time resulting in at least 100% liquid yield.

The hydrocarbon feeds to be treated in accordance with the present invention include those petroleum fractions boiling in the range of about 400°-900° F. Of particular interest is treating diesel fuel to allow a higher end point above the normally attained end boiling point value of 670° F. while maintaining specification pour and cloud points. More specifically, the invention provides for the production of diesel fuel having an end boiling point above 680° F. up to 700° F. This would increase the produced amounts of higher distillates such as jet fuel, kerosene and diesel while decreasing the lower distillates such as heating oil.

The hydrodesulfurization process used in the present invention may be any conventionally known hydrodesulfurization process (HDS) used in the art. For example, the catalyst used in the process could be any conventional hydrodesulfurization catalyst, such as a catalyst comprising a Group VIB metal and a Group VIII metal or their oxides or sulfides. Typical Group VIB metals include chromium, molybdenum and tungsten. Typical Group VIII metals include nickel and cobalt. The HDS process is conducted with the catalyst under hydroprocessing conditions comprising: a pressure of about 300-3000 psia, preferably about 400-800 psia; a temperature of about 550° -800° F., preferably about 600°-720° F; and a liquid hourly space velocity (LHSV) of at least 0.1, preferably 1.0-10.0 $hr^{-1}$. The hydrogen gas used during the process of hydrodesulfurization is passed through the hydrodesulfurization reactor at the rate of between about 100-15,000 SCF/B of feed and preferably between about 500-1000 SCF/B. The hydrogen purity of the gas may vary from about 60-100%.

The present invention allows the effluent from the HDS process to be passed directly to the dewaxing unit. As a matter of fact, it is preferred to pass the total HDS effluent to the dewaxing unit. In the present invention, the HDS and CDW processes may be carried out either in the same reactor or separate reactors. Preferably, the temperature of the CDW process will be higher than the reaction temperature of the HDS process in order to take advantage of the exothermic hydrodesulfurization reaction. In this respect, the inlet temperature to the second reaction zone, in which the catalytic dewaxing treatment is effected, normally should be at least 50° F. greater than the inlet temperature to the first reaction zone where the hydrodesulfurization is carried out.

The use of separate reactors for the HDS and CDW processes offers an advantage in that the reaction zone temperatures for the two reactors can be controlled independently of one another. In some cases a heater may be interposed between the two reaction zones in order to increase the inlet temperature to the CDW reactor to a value above the outlet temperature of the HDS reactor. In other cases the heat generated during the HDS reaction may be sufficient in itself to raise the hydrocarbon stream to the required temperature for the dewaxing procedure and the effluent from the HDS reactor can be applied directly to the CDW reactor without an intermediate heating step.

In rare instances where it is necessary to bring the sulfur content of the diesel fuel to an unusually low level, the hydrotreating step may be carried out at a higher than normal temperature and the first reactor may be operated at a temperature in excess of that for the second reactor. In this case a heat exchanger can be interposed between the first and second reactors to cool the effluent from the hydrodesulfurization zone prior to passing it into the catalytic dewaxing reaction zone. Alternatively, the hydrocarbon feedstock can be supplied initially to the silicalite dewaxing catalyst and the output from the dewaxing reaction supplied to the hydrodesulfurization reaction zone.

As catalyst in the CDW process of the present invention, a crystalline silica polymorph, especially one having pore openings greater than 5 Angstroms in maximum cross-sectional dimension, and particularly between 5 and 6 Angstroms is employed. Such silica polymorphs are commonly designated as silicalite type molecular sieves. Silicalite and its preparation are described in U.S. Pat. No. 4,061,724 issued to Grose et al, the entire disclosure of which is incorporated by reference. Silicalite may be characterized as a crystalline molecular sieve comprising a channel system (or pore structure) of intersecting elliptical straight channels and nearly circular straight channels, with openings in both types of channels being defined by 10 membered rings of oxygen atoms, such opening being between about 5 and 6 Angstroms in maximum cross-sectional dimension. As reported by Flanigen et al in "Silicalite, a New Hydrophobic Crystalline Silica Molecular Sieve" in Nature, Volume 271, pp. 512-516 (Feb. 9, 1978), silicalite is a hydrophobic crystalline silica molecular sieve having the property under ambient conditions of adsorbing benzene (kinetic diameter 5.85 Angstroms) while rejecting molecules larger than 6.2 Angstroms.

As disclosed in the aforementioned U.S. Pat. No. 4,061,724 to Grose, silicalite has an X-ray powder diffraction pattern similar to ZSM-5.

It should be emphasized that, although silicalite is similar to ZSM-type zeolite members in having a similar X-ray powder diffraction pattern, it is dissimilar in several important aspects. Unlike the ZSM-type zeolites such as ZSM-5, silicalite is not an aluminosilicate, containing only trace portions of alumina, due to the commercial impossibility of removing contaminant aluminum components from the reagents used to prepare silicalite. Silicalite may contain up to about 0.75 wt. % alumina, calculated as $Al_2O_3$. Most silicalites contain less than about 0.6 wt. % alumina, calculated as $Al_2O_3$. Additionally, as disclosed by Grose et al in U.S. Pat. No. 4,061,724, silicalite has no ion exchange properties in comparison with aluminosilicates of the zeolite type. Thus, silicalite does not share the zeolitic property of substantial ion exchange common to the crystalline aluminosilicates, and it therefore contains essentially no zeolitic metals cations. It is, however, possible to prepare silicalite with metals present therein as impurities but not as zeolitic cations (as by occlusion). Although operative for purposes herein, such metals-containing silicalites are not preferred. Silicalites containing total metals in only trace proportions, less than about 0.75 percent by weight, calculated as the metals are preferred.

As indicated by the experimental data reported below, the present invention can provide for a substantial reduction in the initial boiling point enabling the recovery of additional gasoline fraction as well as diesel oil. However, by avoiding more severe hydrocracking conditions, the reduction in the average boiling point of the heavier portions of the feedstock is much less pronounced. Specifically, the average boiling point of the 50–100% boiling point fraction of the product effluent is reduced by an average of no more than 30° F. from the average boiling point of the 50–100 volume % boiling fraction of the initial feedstock. In most cases, the incremental decrease for the 50–100 volume % boiling fraction will be no more than 20° F.

The silicalite catalyst employed in the present invention can be in the unmodified form; that is, in the form as synthesized in accordance with the procedure disclosed in U.S. Pat. No. 4,061,724 to Grose. It need not be chemically pretreated to increase its stability to sulfur contaminants or to include metal catalyst components as disclosed in some of the aforementioned patents.

The following experiments are intended to better illustrate the present invention.

Diesel fuel having the properties set forth in Table I was treated with a silicalite catalyst under the conditions set forth in Table IA.

TABLE I

| | |
|---|---|
| API GRAVITY | 30.4 |
| Color | 2 |
| Sulfur - wt. % | 1.35 |
| Flash, F. | 165 |
| Pour Point, F. | +2 |
| Cloud Point, F. | +14 |
| Distillation: | |

TABLE I-continued

| | |
|---|---|
| 1 BP | 370 |
| 10% | 416 |
| 20% | 452 |
| 30% | 482 |
| 50% | 526 |
| 70% | 560 |
| 90% | 612 |
| E.P. | 654 |
| Cetane Index Calc. | 42.8 |
| n-paraffins | 27.2 |

TABLE 1A

| | |
|---|---|
| Temperature, °C. | 360 |
| Pressure, psig | 500 |
| LHSV | 1.0 |
| Hydrogen, SCF/bbl | 500 |
| Catalyst | EB7-1A |

The gas make in Experiment 1 stabilized at 7% by weight of the feed. The cloud point and pour point of the diesel were lowered to 10° to 15° F. The ASTM D-86 distillation of the diesel was also changed. The initial boiling point dropped 200° F., the 10% point dropped 100° F. and the 20% point dropped 40° F. The conversion was exothermic under these conditions. The gas make was too high to be economically advantageous. Any benefits derived from reduced pour point and cloud point would be negated by loss of 7% of the feed.

Diesel fuel, having the properties set forth in Table IIA below, was treated in accordance with the present invention. The HDS catalyst utilized was a nickel-molybdenum catalyst on a refractory support containing 3.2% nickel and 13.2% molybdenum available from Shell Chemical Company under the designation (S-424). The CDW catalyst was a silicalite obtained from Union Carbide Corporation under the designation EB7-1A. This catalyst had a silica/alumina ratio of about 300–320 and a sodium content of less than 0.03 wt. %. Only one reactor was utilized for both the HDS and CDW processes. Although the HDS process is exothermic, additional heat was required to bring the feed to the CDW catalyst to the proper temperature. The other conditions for the process are set forth in Table II.

TABLE II

| | |
|---|---|
| Pressure, psig | 750 |
| Hydrogen, SCF/bbl | 500 |
| Feed Rate for (1) LHSV | 4 ml/min |
| condition on the HDS Catalyst | 5:1 by volume |
| Catalyst | HDS catalyst on top of CDW catalyst |
| Temperature | 700° F. (371° C.) at HDS inlet<br>750° F. (400° C.) at CDW inlet |
| LHSV's | 1, 2, 3, 4.7 and 1 relative to HDS<br>5, 10, 15, 23.6 and 5 relative to CDW |

The temperature was kept constant while the LHSV was changed. Each LHSV was maintained until three samples were taken. The results are shown in Table IIA.

TABLE IIA

| | FEED | 5 LHSV | 5 STRP | 10 LHSV | 10 STRP | 15 LHSV | 15 STRP | 23 LHSV | 23 STRP |
|---|---|---|---|---|---|---|---|---|---|
| API Gravity | 30.4 | 35.6 | 31.5 | 34.7 | 31.9 | 34.9 | 32.3 | 35.8 | 32.2 |
| Color | 2.5 | 3 | 4.5 | 3 | 5 | 2 | 4 | 2 | 3 |

TABLE IIA-continued

| | FEED | 5 LHSV | 5 STRP | 10 LHSV | 10 STRP | 15 LHSV | 15 STRP | 23 LHSV | 23 STRP |
|---|---|---|---|---|---|---|---|---|---|
| Sulfur, Wt. % | 1.25 | .145 | .007 | .181 | .103 | .139 | .085 | .237 | .159 |
| Flash, F | 188 | Rm Temp | 205 | Rm Temp | 208 | Rm Temp | 215 | Rm Temp | 200 |
| Pour Point, F | +12 | −12 | −10 | −20 | −6 | −15 | −5 | −5 | 0 |
| Cloud Point, F | +18 | −2 | −2 | −5 | +2 | +2 | +8 | +6 | +14 |
| Distillation: | | | | | | | | | |
| IBP | 392 | 122 | 406 | 164 | 392 | 162 | 420 | 200 | 436 |
| 10% | 448 | 298 | 444 | 332 | 436 | 386 | 450 | 400 | 464 |
| 20% | 472 | 418 | 466 | 412 | 460 | 420 | 464 | 466 | 480 |
| 30% | 490 | 458 | 484 | 456 | 476 | 474 | 478 | 470 | 496 |
| 50% | 524 | 496 | 520 | 498 | 514 | 510 | 514 | 516 | 524 |
| 70% | 452 | 538 | 568 | 538 | 552 | 554 | 554 | 548 | 572 |
| 90% | 612 | 600 | 636 | 596 | 606 | 612 | 620 | 686 | 638 |
| E.P. | 648 | 640 | 664 | 646 | 646 | 652 | 648 | 650 | 678 |
| Recovery % | 99 | 97 | 98 | 99 | 98 | 98 | 97 | 99 | 99 |
| Cetane Index Calc. | 42 | 47 | 43.3 | 45.8 | 43.2 | 47.5 | 43.8 | 49.9 | 44.8 |
| n-Paraffins | 25.8 | 18.5 | 17.7 | 13.8 | 17.2 | 18.4 | 19.9 | 20.1 | 20.1 |
| 10% OH % Aromatics | — | — | 26.4 | — | 21 | — | 27.5 | — | 37 |

The following trends were seen as the LHSV increased. Cloud point and pour point went from a −2° F. to a +14° F. and from a −12° F. to a 0° F., respectively. The cloud and pour point of the feed were +18° and +14° F., respectively. The average n-paraffin content increased with the increase in LHSV, and the gas make decreased from 2.55–0.55 wt. % with the increase in LHSV. Upon going back to 5 LHSV, no loss in activity of the catalyst could be seen.

Also in this run, samples at the various LHSV's were stripped to see if the lighter material dissolved in the sample was the cause for the decreased cloud and pour point. 10% of the sample was brought overhead. Stripping the sample does not bring the cloud point and pour point back to its original value. The liquid yield represented an increase of 3.24% by volume of the feed.

Experiment No. 3

Diesel fuel, having the properties set forth in Table III below, was treated under the same conditions as Experiment 2 with the following exceptions. The LHSV was maintained at 5 relative to the CDW catalyst. The experiment compares the results at two CDW catalyst inlet temperatures, 370° C. (698° F.) and 384° C. (723° F.). The same catalyst of Experiment 2 was reused without regeneration.

TABLE III

| | | EFFL - 370° F. | | | EFFL - 384° | | |
|---|---|---|---|---|---|---|---|
| | FEED | 1 | 2 | 3 | 4 | 5 | 6 |
| API Gravity | 30.4 | 34.9 | 35 | 34.8 | 35.6 | 35.4 | 35.4 |
| Color | 2.5 | 3 | 2.5 | 2.5 | 2 | 2 | 2 |
| Sulfur, Wt. % | 1.25 | .215 | .175 | .163 | .157 | .084 | .141 |
| Flash, F. | 188 | Rm Temp | Rm Temp | Rm Temp | Rm Temp | Rm Temp | Rm Temp |
| Pour Point, F. | +12 | 0 | 0 | +5 | 0 | −15 | −5 |
| Cloud Point, F. | +18 | +16 | +14 | +18 | +8 | +4 | +5 |
| Distillation: | | | | | | | |
| IBP | 392 | 194 | 228 | 194 | 150 | 160 | 156 |
| 10% | 448 | 398 | 398 | 400 | 392 | 354 | 300 |
| 20% | 472 | 456 | 458 | 456 | 442 | 446 | 444 |
| 30% | 490 | 478 | 482 | 482 | 468 | 472 | 468 |
| 50% | 524 | 514 | 510 | 520 | 506 | 504 | 506 |
| 70% | 562 | 550 | 560 | 562 | 544 | 544 | 548 |
| 90% | 612 | 606 | 626 | 624 | 602 | 600 | 600 |
| E.P. | 648 | 640 | 660 | 658 | 644 | 642 | 646 |
| Recovery % | 99 | 98 | 98 | 98 | 97 | 98 | 98 |
| Cetane Index Calc. | 42 | 48 | 48.6 | 48.5 | 48.2 | 46 | 46 |
| n-Paraffins | 25.8 | 20.3 | 20.5 | 20.4 | 20.5 | 19.9 | 18.9 |

At 370° C., no improvement in cloud point could be seen although there was a 10° F. decrease in pour point. $C_3$ and lower gas make averaged 0.31 wt. %. At 384° C., a decrease of 10° F. was seen in cloud point and a 20° F. decrease was seen in pour point. The $C_3$ and lower gas make averaged 0.58 wt. % at this temperature. It is interesting to note that the improvements seen at this temperature and LHSV compare closely to results seen at 400° C. and 23.6 LHSV in Experiment No. 2. The liquid yield represented an increase of 3.24 volume percent based upon of the feed.

Experiment No. 4

The same catalyst utilized in experiments 2 and 3 was again utilized without regeneration. For clarification, the CDW silicalite catalyst weighed 39.96 grams, had a volume of 48 ml. and had a mesh size of 1/16 inch. The HDS catalyst weighed 188.16 grams, had a volume of 240 ml and had a mesh size of ⅛ inch. The results and other data for Experiment 4 are shown in Table IV below.

TABLE IV

| EFFL | FEED | 1 | 2 | 3 | 4 | 5 | 6 | 7 |
|---|---|---|---|---|---|---|---|---|
| API Gravity | 31.2 | 36 | 36 | 35.8 | 36 | 36 | 36.1 | 35.8 |
| Color | 2 | 1 | 1 | 1 | 1 | 1 | 1 | 1 |
| Sulfur, Wt. % | 1.54 | .227 | .203 | .273 | .247 | .235 | .263 | .247 |
| Flash, F. | Rm Temp | Rm Temp | Rm Temp | Rm Temp | Rm Temp | Rm Temp | Rm Temp | Rm Temp |

TABLE IV-continued

| EFFL | FEED | 1 | 2 | 3 | 4 | 5 | 6 | 7 |
|---|---|---|---|---|---|---|---|---|
| Pour Point, F. | +5 | −10 | 0 | −10 | 0 | −15 | −15 | −15 |
| Cloud Point, F. | +11 | +2 | +4 | −6 | +6 | +5 | +5 | +5 |
| Distillation: | | | | | | | | |
| IBP | 240 | 144 | 160 | 152 | 136 | 168 | 172 | 144 |
| 10% | 431 | 376 | 358 | 352 | 362 | 352 | 356 | 360 |
| 20% | 479 | 440 | 432 | 436 | 438 | 430 | 424 | 434 |
| 30% | 504 | 474 | 464 | 468 | 472 | 446 | 470 | 468 |
| 50% | 542 | 516 | 510 | 512 | 536 | 512 | 510 | 510 |
| 70% | 576 | 554 | 548 | 550 | 552 | 548 | 550 | 550 |
| 90% | 619 | 596 | 594 | 600 | 598 | 594 | 600 | 600 |
| E.P. | 660 | 642 | 630 | 632 | 638 | 630 | 642 | 638 |
| Recovery % | 98 | 99 | 99 | 98 | 98 | 98 | 98 | 97 |
| Cetane Index Calc. | 45 | 50 | 49.3 | 52.1 | 49.6 | 49.5 | 49 | |
| n-Paraffins | 20.3 | 21.2 | 21.3 | 20.9 | 21.8 | 20.7 | 21 | 21.6 |
| $C_3$ lower, total wt % of feed | | 0.53 | 0.52 | 0.57 | 0.41 | 0.39 | 0.34 | 0.38 |
| LHSV-CDW | 5.0 | 5.01 | 5.13 | 5.13 | 5.13 | 5.06 | 5.00 | |
| HDS Bed T °C. | | | | | | | | |
| Inlet | | 366 | 366 | 366 | 367 | 366 | 366 | 366 |
| Outlet | | 384 | 384 | 384 | 383 | 383 | 383 | 383 |
| CDW Bed T °C. | | | | | | | | |
| Inlet | | 386 | 386 | 386 | 386 | 385 | 385 | 385 |
| Outlet | | 398 | 398 | 398 | 398 | 397 | 399 | 398 |

As can be seen from Table IV, an improvement of about 6° F. was seen in cloud point and about 14° F. in pour point. The average $C_3$ and lower gas make was 0.45 wt. % of the feed. It should be noted that in this experiment, the diesel feed had a lower n-paraffin content than the diesel feed shown in the previous experiments. The liquid yield represented an increase of 2.97 volume percent of the feed.

TABLE V

| EFFL | FEED | 1 | 2 | 3 | 4 | 5 | 6 | 7 | 8 | 9 |
|---|---|---|---|---|---|---|---|---|---|---|
| API Gravity | 30.9 | 32.7 | 32.6 | 32.9 | 32.3 | 32.9 | 32.8 | 32.7 | 32.5 | 32.5 |
| Color | 1 | 4 | 3.5 | 3.5 | 2.5 | 2.5 | 2.5 | 2 | 2 | 2 |
| Sulfur wt. % | .337 | .103 | .099 | .101 | .103 | .109 | .101 | .111 | .113 | .105 |
| Flash, F. | 195 | Rm Temp | Rm Temp | Rm Temp | Rm Temp | Rm Temp | Rm Temp | Rm Temp | Rm Temp | Rm Temp |
| Pour Point, F. | +15 | −5 | −5 | −0 | −4 | −5 | −5 | −5 | −6 | −5 |
| Cloud Point, F. | +34 | +16 | +10 | +16 | +16 | +14 | +16 | +18 | +20 | +16 |
| Distillation: | | | | | | | | | | |
| IBP | 395 | 148 | 142 | 138 | 150 | 140 | 130 | 184 | 172 | 154 |
| 10% | 439 | 398 | 376 | 364 | 382 | 378 | 404 | 412 | 396 | 394 |
| 20% | 473 | 456 | 442 | 440 | 446 | 448 | 454 | 448 | 454 | 450 |
| 30% | 502 | 486 | 474 | 478 | 484 | 484 | 488 | 484 | 484 | 484 |
| 50% | 545 | 540 | 524 | 532 | 534 | 536 | 536 | 536 | 536 | 534 |
| 70% | 584 | 578 | 566 | 576 | 578 | 580 | 576 | 580 | 578 | 576 |
| 90% | 646 | 640 | 624 | 634 | 636 | 636 | 636 | 640 | 640 | 634 |
| E.P. | 695 | 692 | 686 | 670 | 690 | 680 | 680 | 678 | 692 | 682 |
| Recovery, % | 98 | 97 | 98 | 97 | 98 | 97 | 97 | 98 | 98 | 98 |
| Cetane Index Calc. | 44.8 | 47.1 | 45.4 | 46.7 | 45.9 | 47.1 | 46.9 | 46.7 | 46.4 | 46.2 |
| HDS Bed T° C. | | | | | | | | | | |
| Inlet | | 356 | 360 | 356 | 357 | 352 | 352 | 352 | 356 | 355 |
| Outlet | | 385 | 388 | 387 | 387 | 387 | 386 | 386 | 390 | 390 |
| CDW Bed T° C. | | 384 | 389 | 388 | 391 | 390 | 390 | 390 | 394 | 394 |
| $C_3$ and lower gas | | 0.77 | 0.89 | 0.84 | 0.83 | 0.81 | 0.76 | 0.66 | 0.79 | 0.75 |

Experiment No. 5

A 700° F. end point diesel blend was treated in accordance with the present invention. The catalyst bed utilized in Experiments 2, 3 and 4 was again utilized without regeneration. The diesel blend was made up of 10% overhead of crude atmospheric gas oil and diesel stripper bottoms. The pressure was 480 psig at the inlet. Hydrogen feed was at the rate of 500 SCF/bbl.

The feed rate was 8 ml/min to give an LHSV of 10 relative to the CDW silicalite catalyst. The temperatures were 670° F. (356° C.) at HDS inlet and 720° F. (383° C.) at CDW inlet. The experimental data and results are shown in Table V.

The catalyst was utilized without regeneration and had 19.1 bbl/lb of service to its credit without any noticeable deactivation. The cloud point was reduced from +34° F. to about +16° F. and the pour point was reduced from +15° F. down to −5° F. The $C_3$ and lower gas make was about 0.79 wt. %.

When the above distillate dewaxing is applied to a certain refinery, it would enable 2000 BPD of kerosene to be pulled out of the diesel pool while maintaining the diesel cloud point specification of 14° F. Additionally, the cloud point specification is maintained while raising the diesel end point to 700° F., thereby upgrading 800 BPD of atmospheric gas oil and 250 BPD of carbon black oil to diesel. About 0.8 wt. % of the distillate charge is cracked to fuel gas ($C_3$ and lower) and about 8.0 wt. % is cracked to gasoline. The net effect is a volume gain of 1.5% higher than that achieved by hydrotreating alone.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. A process for catalytic dewaxing a hydrocarbon feed having an initial boiling point of less than 500° F. and a final boiling point of less than 900° F., comprising passing the hydrocarbon feed through a reaction zone containing a crystalline silica polymorph silicalite catalyst at mild dewaxing conditions under which the $C_3$ and lower hydrocarbon gas make from said reaction zone is not greater than 2 wt. % based on the feed.

2. The process of claim 1 wherein the $C_3$ and lower hydrocarbon gas make from said reaction zone is no greater than 1 wt. % based upon said feed.

3. A process for catalytically dewaxing a hydrocarbon feed having an initial boiling point of less than 500° F. and a final boiling point of less than 900° F., comprising passing the hydrocarbon feed through a reaction zone containing a crystalline silica polymorph silicalite catalyst at mild dewaxing conditions under which the liquid yield from said reaction zone is greater than 100% by volume based on the feed.

4. A process for reducing the pour point of a sulfur containing gas oil boiling in the range of 400°-900° F. comprising the steps of:

(a) catalytically hydrotreating said gas oil to remove sulfur therein; and (b) dewaxing said gas oil by passing said gas oil over a crystalline silica polymorph silicalite catalyst at mild dewaxing conditions under which the total $C_3$ and lower hydrocarbon gas make is no greater than 2 wt. % based on said gas oil feed.

5. The process of claim 4 wherein said hydrotreating step is carried out initially and the effluent from said hydrotreating step is then subjected to said dewaxing step.

6. The process of claim 5 wherein said dewaxing step is carried out at a higher temperature than said hydrotreating step.

7. The process of claim 4 wherein the said dewaxing step is carried out initially and the effluent from said dewaxing step is passed to said hydrotreating step.

8. The process of claim 4 wherein step (b) is carried out at a space velocity greater than the space velocity of step (a).

9. In the dewaxing of hydrocarbons to provide a diesel oil fraction of reduced pour point, the method comprising:

(a) feeding hydrocarbon fraction having an initial boiling point of less than 500° F. and a final boiling point of less than 900° F. into a first reaction zone operated at a temperature within the range of 550°-800° F. and a pressure of at least 300 psia and within first reaction zone catalytically hydrotreating said fraction to remove sulfur therefrom;

(b) passing the hydrotreated hydrocarbon fraction from said first reaction zone to a second reaction zone under operating conditions including a temperature within the range of 650°-850° F. to limit the amount of $C_1$-$C_3$ hydrocarbons produced by cracking of said fraction to no more than 2 wt. % of the feed in step (a) and within said second zone dewaxing said fraction over a silicalite dewaxing catalyst to provide a product having a lower pour point than said feed; and (c) withdrawing a diesel oil product from said second reaction zone.

10. The process of claim 9 wherein said diesel oil product has a final boiling point in excess of 670° F.

11. The process of claim 9 wherein said diesel oil product has a final boiling point of at least 680° F.

12. The process of claim 9 wherein said first and second reaction zones are in separate reactors.

13. The process of claim 12 wherein the reactor for said second reaction zone is operated at a higher temperature than the reactor for said first reaction zone.

14. The process of claim 13 wherein the incremental difference between the inlet temperature to said first reaction zone and the inlet temperature in said second reaction zone is at least 50° F.

15. The process of claim 12 wherein the reaction zone temperatures in said first and second reactors are controlled independently of one another.

16. The process of claim 9 wherein the average boiling point of the 50-100% volume boiling fraction of the product effluent from said second reaction zone is reduced by an average of no more than 30° F. from the 50-100% boiling fraction of the hydrocarbon fraction fed to said first reaction zone.

17. The process of claim 9 wherein step (b) is carried out at a space velocity greater than the space velocity of step (a).

* * * * *